US006076495A

United States Patent [19]

Takahashi et al.

[11] Patent Number: 6,076,495

[45] Date of Patent: Jun. 20, 2000

[54] BEARING ARRANGEMENT FOR VERTICAL ENGINE

[75] Inventors: Masanori Takahashi; Hiroshi Oishi, both of Hamamatsu, Japan

[73] Assignee: Sanshin Kogyo Kabushiki Kaisha, Hamamatsu, Japan

[21] Appl. No.: 08/834,814

[22] Filed: Apr. 8, 1997

[30] Foreign Application Priority Data

Apr. 8, 1996 [JP] Japan ..... 8-111188
Apr. 8, 1996 [JP] Japan ..... 8-111189

[51] Int. Cl.[7] ..... F01M 11/00

[52] U.S. Cl. ..... 123/196 W; 123/195 C; 123/196 R; 184/6.18; 440/900

[58] Field of Search ..... 123/196 R, 195 C, 123/195 P, 196 CP, 196 W, 195 H, 195 HC; 184/6.5, 6.18; 440/88, 900

[56] References Cited

U.S. PATENT DOCUMENTS 4,911,118 3/1990 Kageyama et al. ..... 123/195 H
5,072,809 12/1991 Shibata ..... 184/6.13
5,085,186 2/1992 Kobayashi .
5,460,555 10/1995 Fukuoka et al. .
5,752,866 5/1998 Takahashi et al. ..... 440/88
5,755,606 5/1998 Takahashi et al. ..... 440/84
5,769,036 6/1998 Takahashi et al. ..... 123/41.33
5,823,835 10/1998 Takahashi et al. ..... 440/2

*Primary Examiner*—Noah P. Kamen
*Assistant Examiner*—Hai Huynh
*Attorney, Agent, or Firm*—Knobbe, Martens, Olson & Bear LLP

[57] ABSTRACT

A crankshaft bearing support arrangement is disclosed for an engine arranged such that the crankshaft is vertically oriented. The crankshaft rotates within a crankcase chamber defined by the cylinder block and a crankcase cover connected thereto. First web members which support half-bearings extend from the cylinder block. Mating half-bearings are supported by second web members position opposite the first web members. An oil flow passage is defined through the crankcase chamber generally opposite the cylinder block from a top end to a bottom end of the chamber. In one arrangement, the oil flow passage comprises individual passages through the second web members. In another arrangement, the oil flow passage comprises a space between an end of the second web members opposite the cylinder block and the crankcase cover. The crankshaft support arrangement allows lubricating oil introduced into the crankcase chamber to flow downwardly from the top end to the bottom end of the chamber for return to an oil reservoir for recirculation through the engine.

18 Claims, 17 Drawing Sheets

BEARING ARRANGEMENT FOR VERTICAL ENGINE

FIELD OF THE INVENTION

The present invention relates to an internal combustion engine. More particularly, the engine is an improved crankshaft bearing arrangement for a vertically oriented engine.

BACKGROUND OF THE INVENTION

Internal combustion engines which are utilized to power outboard motors are commonly oriented vertically in a cowling of the motor. In this arrangement, the pistons reciprocate along horizontal axis. Each piston is connected, via a crankrod, to a vertically extending crankshaft. This crankshaft extends out the bottom of the engine in driving relation with a water propulsion device of the outboard motor.

This outboard motor engine arrangement has the advantage that the crankshaft is oriented for simple connection to a transmission or other drive for the water propulsion device. Several disadvantages are associated with this engine arrangement, however. One problem relates to the lubricating system.

As is well known, in these engines crank-bearing halves are connected to crankshaft supports extending from the cylinder block for rotatably supporting the crankshaft. Corresponding bearing halves are supported by mating supports extending from a crankcase cover which is connected to the block. Normally, the bearing halves supported by the cover are connected to solid webs extending inwardly from a wall of the cover.

Oil is supplied by an oil pump from an oil pan to oil passages throughout the engine. These passages include a main passage and several bearing passages for lubricating the crankshaft bearing areas. It is then intended for the lubricating oil to drain through the crankcase to the bottom of the crankcase for recovery and delivery back to the oil pan.

It has been found, however, that much of the lubricating oil is thrown by the rotating crankshaft against the wall of the crankcase cover. This oil largely becomes trapped, since the bearings and their associated webs which extend inwardly from the wall of the cover prevent the movement of the oil downwardly to the bottom of the crankcase. The total amount of oil available for distribution through the engine while it is running is reduced, and the oil within the crankcase may be foamed as it is thrown from the crankshaft against the cover, runs back towards the crankshaft, and is thrown against the wall in repeating fashion.

A bearing arrangement for rotatably supporting a crankshaft of a vertically arranged engine, where a drain path is provided for the oil used to lubricating the bearings, is desired.

SUMMARY OF THE INVENTION

In accordance with the present invention, there is provided an improved crankshaft supporting arrangement for an engine arranged so that the crankshaft is vertically extending. At least a portion of the crankshaft is rotatably positioned within a crankcase chamber defined by a cylinder block of the engine and a crankcase cover connected thereto. The crankshaft is supported within the crankcase chamber by at least one first crankshaft supporting member which extends from the cylinder block and at least one corresponding second crankshaft supporting member positioned on the opposite side of the crankshaft.

In accordance with the present invention, an oil flow passage or path is provided through the crankcase chamber from a top end to a bottom end thereof, generally opposite the cylinder block. In this manner, lubricating oil which is delivered to the crankcase chamber and dispersed therein easily drains to the bottom of the crankcase chamber for return to an oil reservoir for redistribution throughout the engine.

In accordance with a first embodiment of the present invention, the oil flow path is defined by passage through the second crankshaft supporting member. In this arrangement, the second crankshaft supporting member preferably comprises a web member extending inwardly from the crankcase cover, and having a passage extending through the web member generally adjacent the cover.

In accordance with a second embodiment of the present invention, the oil flow path is defined by a space between the second crankshaft supporting member and the cover, generally opposite the corresponding first crankshaft supporting member.

In all embodiments, a deflector plate is preferably provided in the chamber for deflecting oil which is dispersed through the chamber by the rotating crankshaft. The plate is oriented to direct oil which impacts it into the oil flow path.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 having an improved bearing arrangement in accordance with the present invention. In general, the bearing arrangement is provided to rotatably support a vertically extending crankshaft of the engine, and allow oil which is provided for lubricating the crankshaft and associated support bearings, to flow vertically down through a crankcase of the engine.

Figure 1:
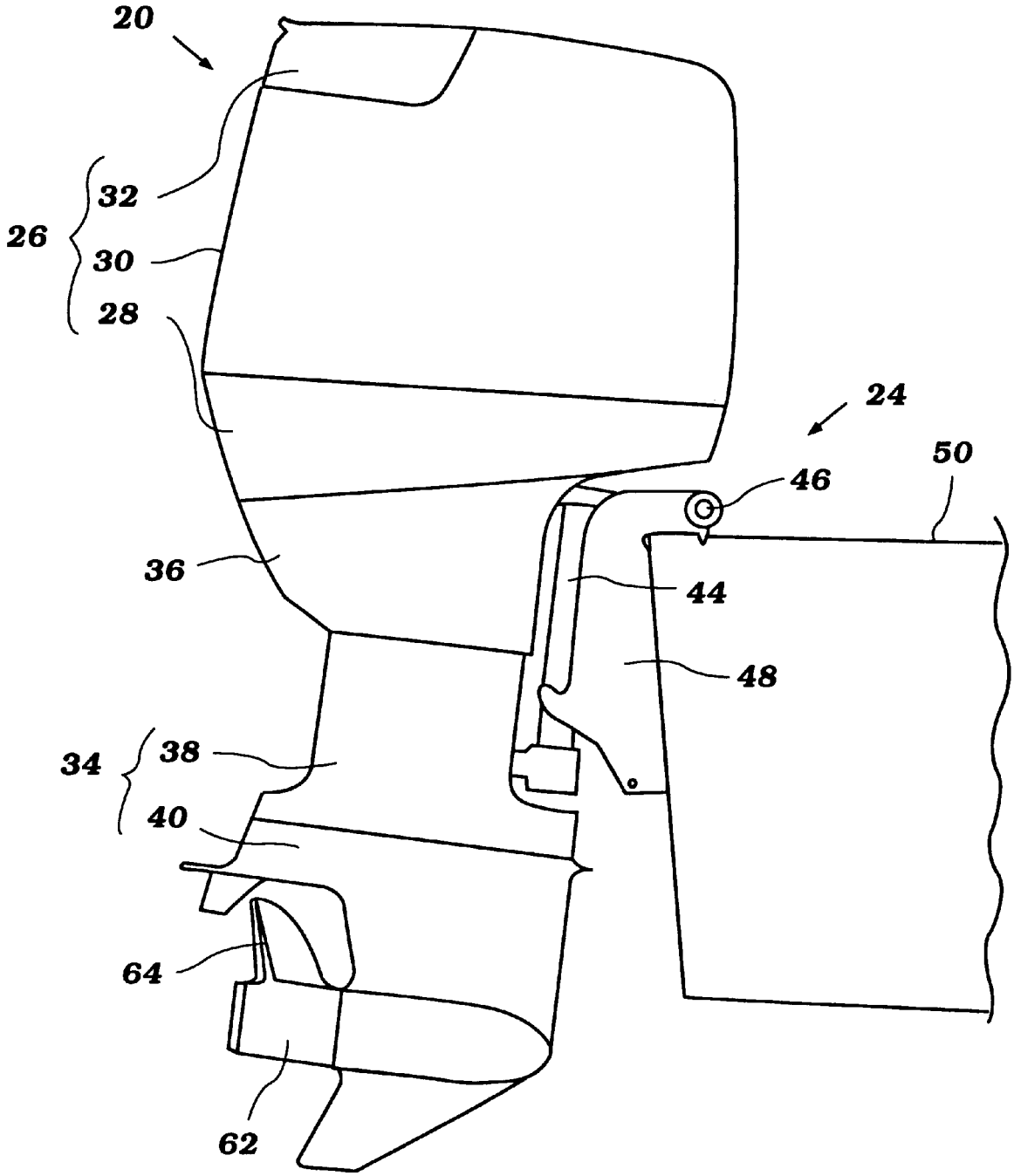
FIG. 1 is a side view of an outboard motor of the type which may be powered by an engine having a crankshaft bearing arrangement in accordance with the present invention, the motor connected to a watercraft.

As best illustrated in FIG. 1, the outboard motor 20 is utilized to power a watercraft 24. The outboard motor 20 has a powerhead area 26 comprised of a lower tray portion 28 and a main cowling portion 30. An air inlet or vent area 32 is provided in the main cowling portion 30 for providing air to an engine 22 therein, and for exhausting heated air from within the cowling 30, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket 42. The steering shaft is supported for steering movement about a vertically extending axis within a swivel bracket 44. The swivel bracket 44 is connected by means of a pivot pin 46 to a clamping bracket 48 which is attached to a transom portion of a hull 50 of the watercraft. The pivot pin 46 permits the outboard motor 20 to be trimmed and tilted up about the horizontally disposed axis formed by the pivot pin 46.

Figure 2:
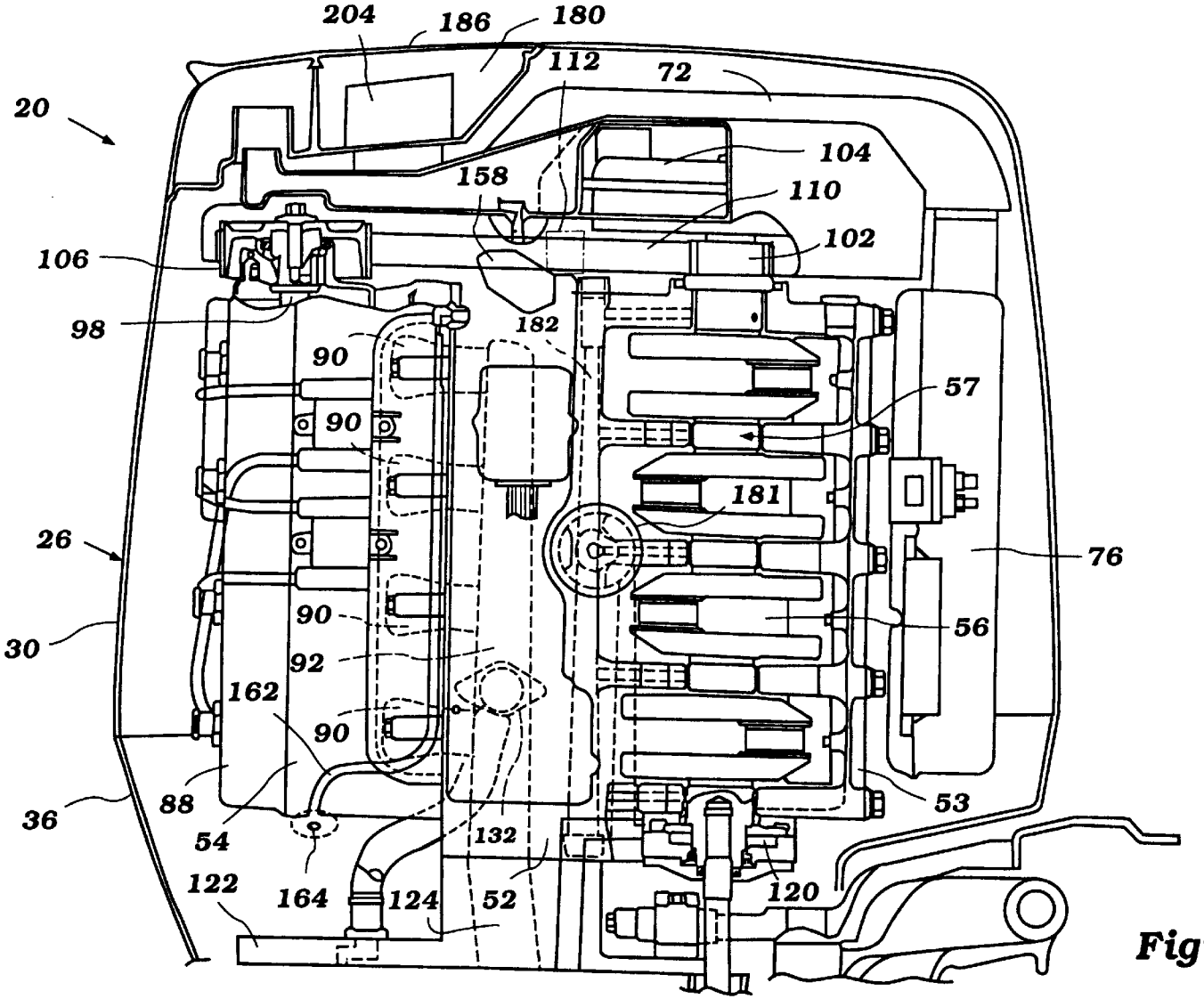
FIG. 2 is a cross-sectional side view of a top portion of the motor illustrated in FIG. 1, with an engine having a Crankshaft bearing arrangement in accordance with a first embodiment of the present invention also illustrated in cross-section.

As best illustrated in FIG. 2, the power head 26 of the outboard motor 20 includes the engine 22 which is positioned within the cowling portion 30. The engine 22 is preferably of the inline, four-cylinder, four-cycle variety, and thus includes a cylinder block 52 which has a cylinder bank closed by a cylinder head assembly 54 in a manner which will be described. As also illustrated in FIG. 2, the engine 22 is preferably oriented within the cowling 30 such that its cylinder head 54 is positioned on the block 52 on the side opposite the watercraft's transom.

A crankshaft 56 is rotatably journalled in a crankcase chamber 57 formed by the cylinder block 52 a crankcase cover 53, in a manner described in greater detail below. As is typical with outboard motor practice, the engine 22 is mounted in the power head 26 so that the crankshaft 56 rotates about a vertically extending axis. This facilitates coupling to a drive shaft 60 in a manner which will be described.

The drive shaft 60 depends into the lower unit 34, wherein it drives a bevel gear and a conventional forward-neutral-reverse transmission. The transmission is not illustrated herein, because its construction per se forms no part of the invention. Therefore, any known type of transmission may be employed. A control is preferably provided for allowing an operator to remotely control the transmission from the watercraft 24.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

Figure 3:
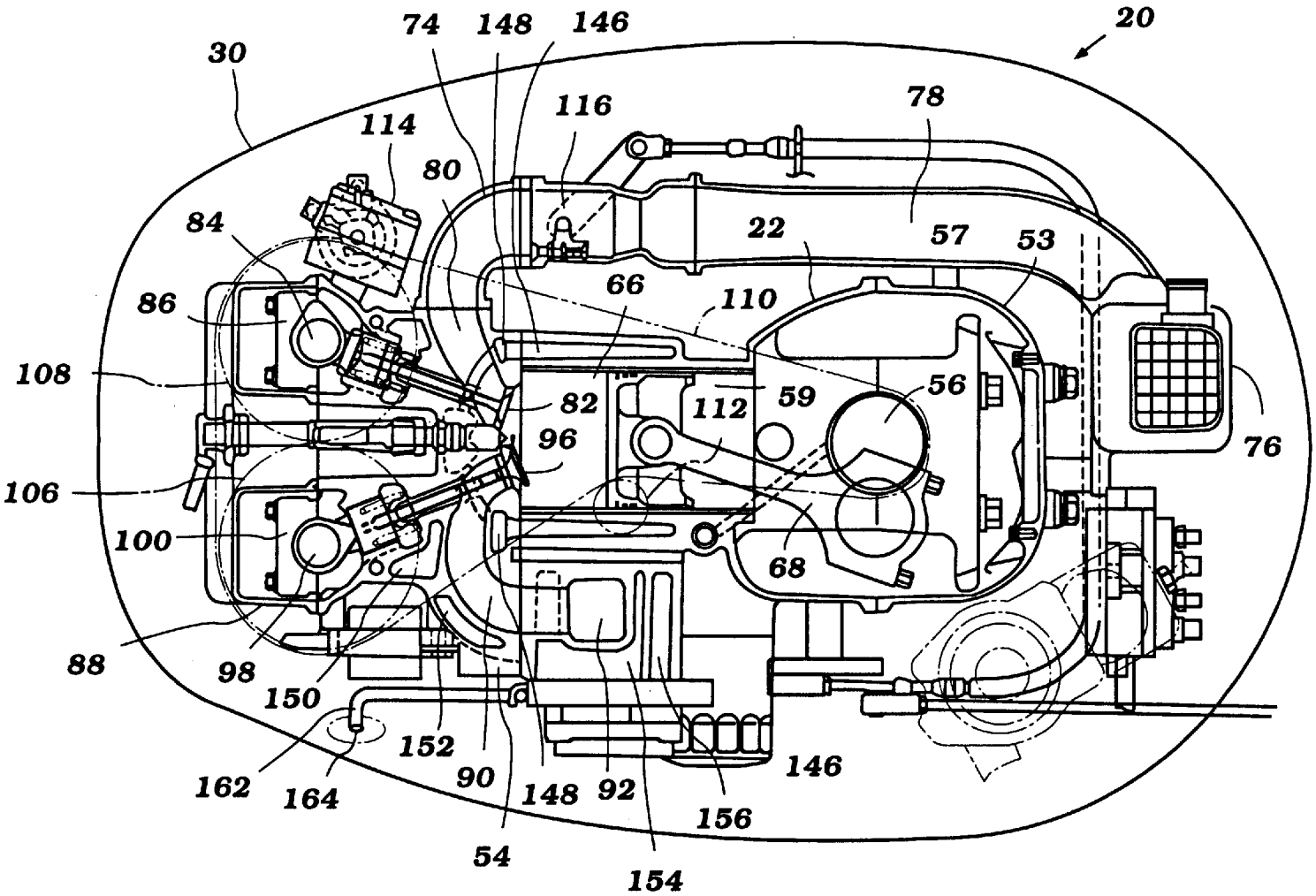
FIG. 3 is a cross-sectional top view of the motor and engine illustrated in FIG. 1.

The construction of the engine 22 and the crankshaft bearing arrangement of the present invention will now be described in more detail. As illustrated in FIG. 3, the engine 22 has a number of variable volume combustion chambers 59, preferably totaling four in number, arranged in inline fashion. It should be understood that there may be as few as one combustion chamber, or more than four.

Each combustion chamber has a piston 66 mounted therein for reciprocation, the piston connected to the crankshaft 56 via a connecting rod 68. The cylinder head 54 is preferably connected to the cylinder block 52 via a number of bolts, as is known in the art.

As illustrated in FIGS. 2–3, an intake system 70 provides air to each combustion chamber. Described here is the "engine" portion of the intake system 70 including a surge tank 76 and air delivery system. The portion of the intake system 70 which delivers air from the vent portion 32 of the cowling 30 to the surge tank 76 is described in more detail below.

Air which is routed from the vent portion 32 in the manner described below is provided through a passage 72 to a surge tank 76. The surge tank 76 is preferably positioned on the end of the engine 22 facing the watercraft 24. Air is routed from the surge tank 76 by runners 78 to passages extending through an intake manifold 74. Each passage in the manifold 74 leads to a corresponding passage 80 positioned within the cylinder head 54 leading to the combustion chamber. An inlet passage 80 is provided corresponding to each combustion chamber 59.

Means are provided for controlling the passage of air through each inlet passage 80 to its respective combustion chamber 59. Preferably, this means comprises an intake valve 82. As illustrated, all of the intake valves 82 are preferably actuated by an intake camshaft 84. The intake camshaft 84 is mounted for rotation with respect to the head 54 and connected thereto with at least one bracket 86. The camshaft 84 is enclosed by a camshaft cover 88 which is connected to the head 54.

An exhaust system is provided for routing the products of combustion within the combustion chambers 59 to a point external to the engine 22. In particular, an exhaust passage 90 leads from each combustion chamber to a passage 92 in an exhaust manifold portion 94 of the engine 22. The remainder of the exhaust system will be described in more detail below.

Means are also provided for controlling the flow of exhaust from each combustion chamber 59 to its respective exhaust passage 92. Preferably, this means comprises an exhaust valve 96. Like the intake valves 82, the exhaust valves 96 are preferably all actuated by an exhaust camshaft 98. The exhaust camshaft 98 is journalled for rotation with respect to the cylinder head 54 and connected thereto with at least one bracket 100. The exhaust camshaft 98 is enclosed within the camshaft cover 88.

As best illustrated in FIGS. 2 and 3, means are provided for driving the camshafts 84,98. A timing belt pulley 102 is mounted on a top end of the crankshaft 56 positioned outside of the cylinder block 52, and just below a flywheel 104 also positioned on the crankshaft 56. An exhaust camshaft pulley 106 is mounted on an end of the exhaust camshaft 98 extending from the top end of the engine 22, and an intake camshaft pulley 108 is mounted on an end of the intake camshaft 84 extending from the top end of the engine. A drive belt 110 extends around the timing belt pulley 102 and the exhaust and intake camshaft pulleys 106,108, whereby the camshaft 56 indirectly drives the camshafts 84,98. One or more tensioner pulleys 112 may be provided for maintaining the belt in a taunt condition.

A fuel delivery system is provided for delivering fuel to each combustion chamber 59 for combustion therein. The fuel delivery system preferably includes a fuel tank (not shown) and at least one fuel pump 114 for pumping fuel from the tank and delivering it to each combustion chamber 59. As known to those skilled in the art, the fuel may be delivered into the incoming air stream, such as with a carburetor or fuel injector, or directly injected into the combustion chamber with a fuel injector.

A throttle 116 is provided for controlling the flow of air into each combustion chamber 59. Preferably, the throttle 116 comprises a moveable plate positioned within each runner 78. The throttle 116 is preferably controlled through a throttle control 115 in the form of a cable extending from a control area of the watercraft 24, whereby the operator of the watercraft may control the throttle remotely therefrom.

A suitable ignition system is provided for igniting an air and fuel mixture within each combustion chamber 59. Such systems are well known to those skilled in the art, and as such forms no portion of the invention herein, such is not described in detail here.

Figure 5:
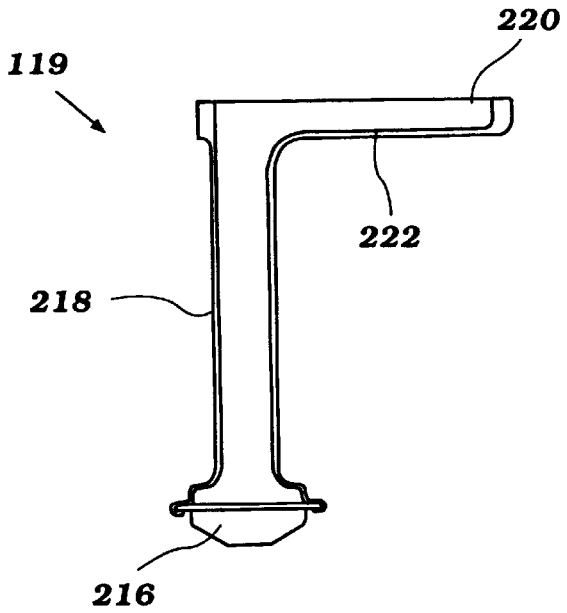
FIG. 5 is a cross-sectional view of an oil pick-up of a lubricating system of the engine illustrated in FIG. 4.
Figure 6:
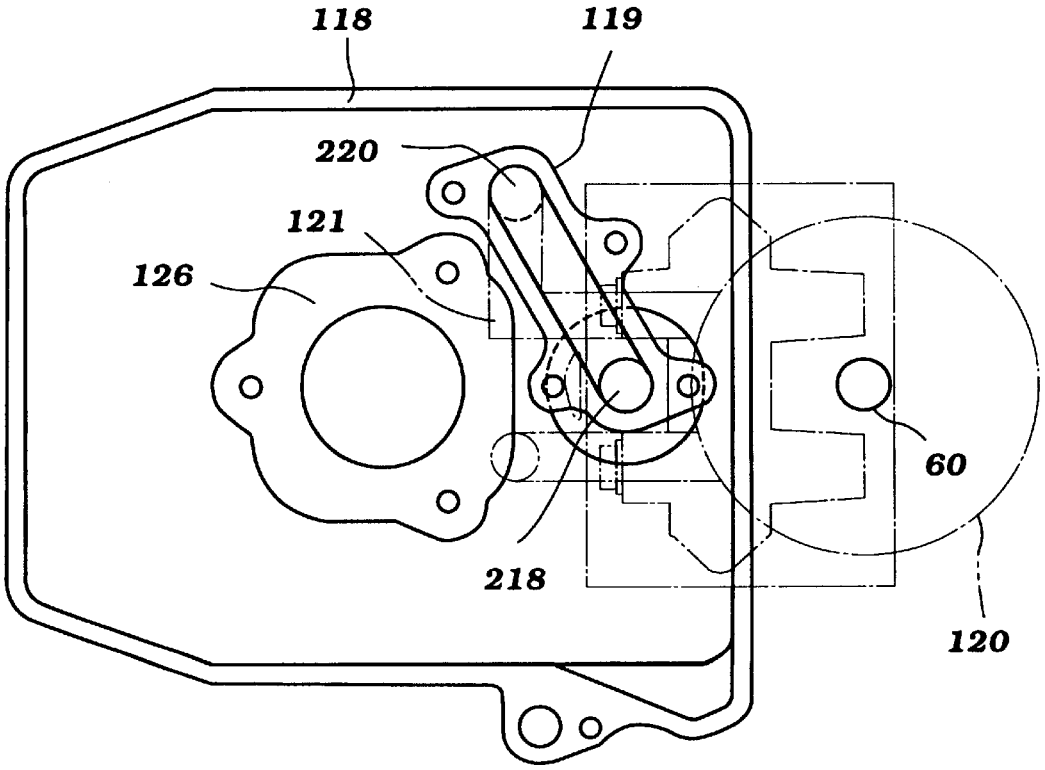
FIG. 6 a cross-sectional view of an oil pan, the oil pick-up, and an oil pump of the lubricating system

The engine 22 includes a lubricating system for providing lubricant to the various portions of the engine. The lubricating system is not described in detail here, and may be of a variety of types found suitable to those skilled in the art. Generally, the lubricating system includes an oil reservoir 118 positioned below the engine 22. The reservoir 118 is defined by a wall 117 and is in communication with an oil pump 120 via an oil pick-up 119. As best illustrated in FIG. 5, the pick-up 119 has an inlet 216, a generally vertically extending tube 218 and a generally horizontally extending delivery part 220, all of which are formed by a housing 222 which is connected to an exhaust guide 122. The oil pump 120 is preferably positioned on the end of the crankshaft 56 at the bottom of the engine 22. The oil pump 120 pumps lubricant from the reservoir 118 through the pick-up 119 and a passage 121 leading through the exhaust guide 122 and a connection passage 123 leading through the cylinder block 52 to the pump, and then through oil passages throughout the engine 22, as described in more detail below. The pumped oil drains from the engine 22 back to the reservoir 118 for recirculation by the pump 120.

Figure 4:
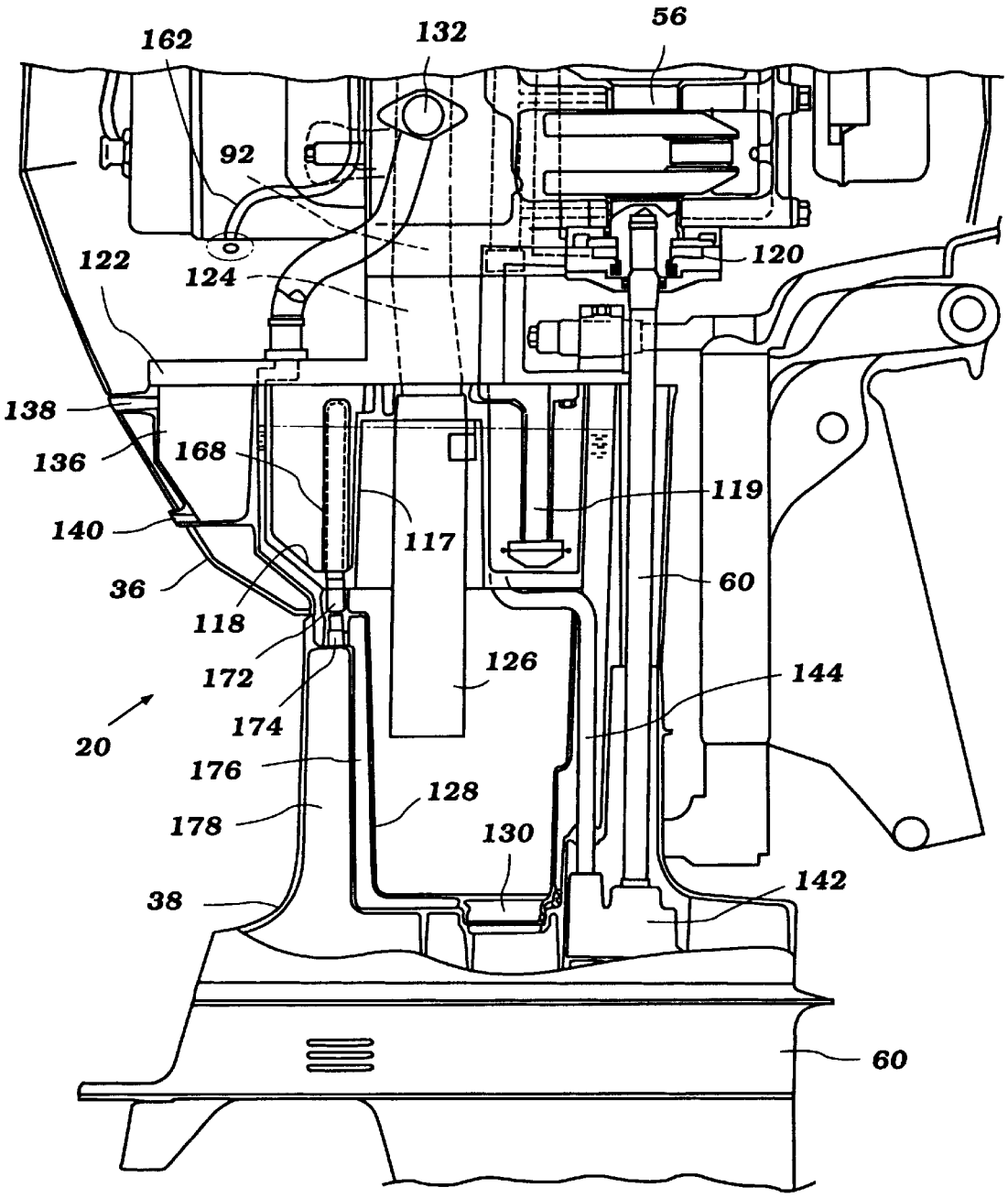
FIG. 4 is a partial cross-sectional side view of a lower portion of the motor illustrated in FIG. 1.

As illustrated in more detail in FIG. 4, the exhaust manifold is preferably formed integrally with the cylinder block 52. In this arrangement, the exhaust passage 92 is simply a passage extending generally vertically through an extended portion of the cylinder block 52.

As best illustrated in FIGS. 2 and 4, the exhaust guide 122 is positioned at the bottom end of the engine 22. The exhaust guide 122 has a passage 124 extending therethrough which is aligned with the passage 92 at its top side. An exhaust pipe 126 is connected to the bottom side of the exhaust guide 122 in alignment with the passage 124. The exhaust pipe 126 terminates within a chamber formed within a muffler 128.

The muffler 128 is positioned within the lower unit 38 and between the drive shaft 60 and a cooling liquid return. An exhaust gas outlet 130 is provided in the bottom end of the muffler 128, through which the exhaust gas is routed to a point external of the motor 20, normally through a passage extending through the hub 62 of the propeller 64.

When the exhaust pressure is low, normally when the engine speed is low, the exhaust gas is diverted to an above-water exhaust gas discharge. As illustrated in FIG. 4, this discharge comprises an expansion chamber 136 and first and second exhaust ports 138,140. The exhaust ports 138, 140 extend through the apron 36 from the chamber 136 for exhausting gases therefrom. The lower exhaust port 140 is provided for use in allowing condensed liquids to drain from the chamber 136.

The engine 22 preferably includes a liquid cooling system. Cooling liquid, preferably cooling water from the body of water in which the motor 22 is positioned, is pumped by a pump 142 positioned in the lower unit 34. The pump 142 is preferably driven by the drive shaft 60, and expels the cooling liquid or water upwardly through a cooling liquid pipe 144. This cooling liquid passes into a number of cooling liquid passages throughout the cylinder block 52 and head 54. As best illustrated in FIG. 3, these passages include a cooling liquid jacket 146 surrounding the combustion chambers 59 in communication with a similar cooling liquid jacket or passage 148 in the cylinder head 54. Cooling liquid passages 150,152 are flirter provided in the cylinder head 54 adjacent the exhaust valves 96 and exhaust passages 90. A cooling liquid passage 154 is preferably provided in the manifold portion 94 of the cylinder block 52 on a side of the exhaust passage 92 defined therein opposite the combustion chambers 59. All of the cooling liquid passages lead to a cooling liquid outlet passage 156. Preferably, the cooling liquid flows first through passage 154 and then passages 150,152, before flowing to the passages 146,148 surrounding the combustion chamber 59.

The cooling system preferably includes a thermostat 158 for controlling the flow of cooling liquid through the various cooling liquid passages. In particular, the thermostat 158 is arranged at the top end of the engine 22 for controlling the flow of cooling liquid through the engine 22 to the outlet passage 156. The thermostat 158 prevents the cooling liquid from flowing through the engine 22 when the temperature of the cooling liquid therein is below a predetermined temperature, thereby allowing the engine to warm up.

As best illustrated in FIGS. 2 and 4, a cooling liquid pressure relief valve 132 is provided. This valve 132 is preferably in communication with the cooling liquid passage 154, and has a relief line 134 extending therefrom. In the instance where the cooling liquid pressure within the cooling passages exceeds a predetermined pressure, the pressure relief valve 132 opens, allowing cooling liquid to flow through the line 134 to a cooling liquid pool or chamber 176.

Cooling liquid which circulates through the engine 22 to the outlet passage 156 (when the thermostat 158 is open)

passes downwardly through a cooling liquid discharge pipe 167 into a chamber 176 which extends at least partially around the oil tank 118, muffler 128 and other components. An overflow pipe 168 has its top end positioned in the chamber 176, and extends to first and second passages 172,174 leading to a discharge tank 178, before passing out of the motor 20 back to the body of water from which it was drawn.

In accordance with the present invention, a cooling water tell-tale is provided, allowing the operator of the watercraft 24 to visually determine that coolant is being provided to the engine 22. Referring to FIGS. 3 and 4, a pilot line 162 extends from one of the cooling liquid passages to a pilot port 164. The port 164 is positioned above the water line, such that a small amount of cooling liquid is expelled therefrom as a visual identifier to the operator that cooling liquid is being provided to the engine.

Figure 7:
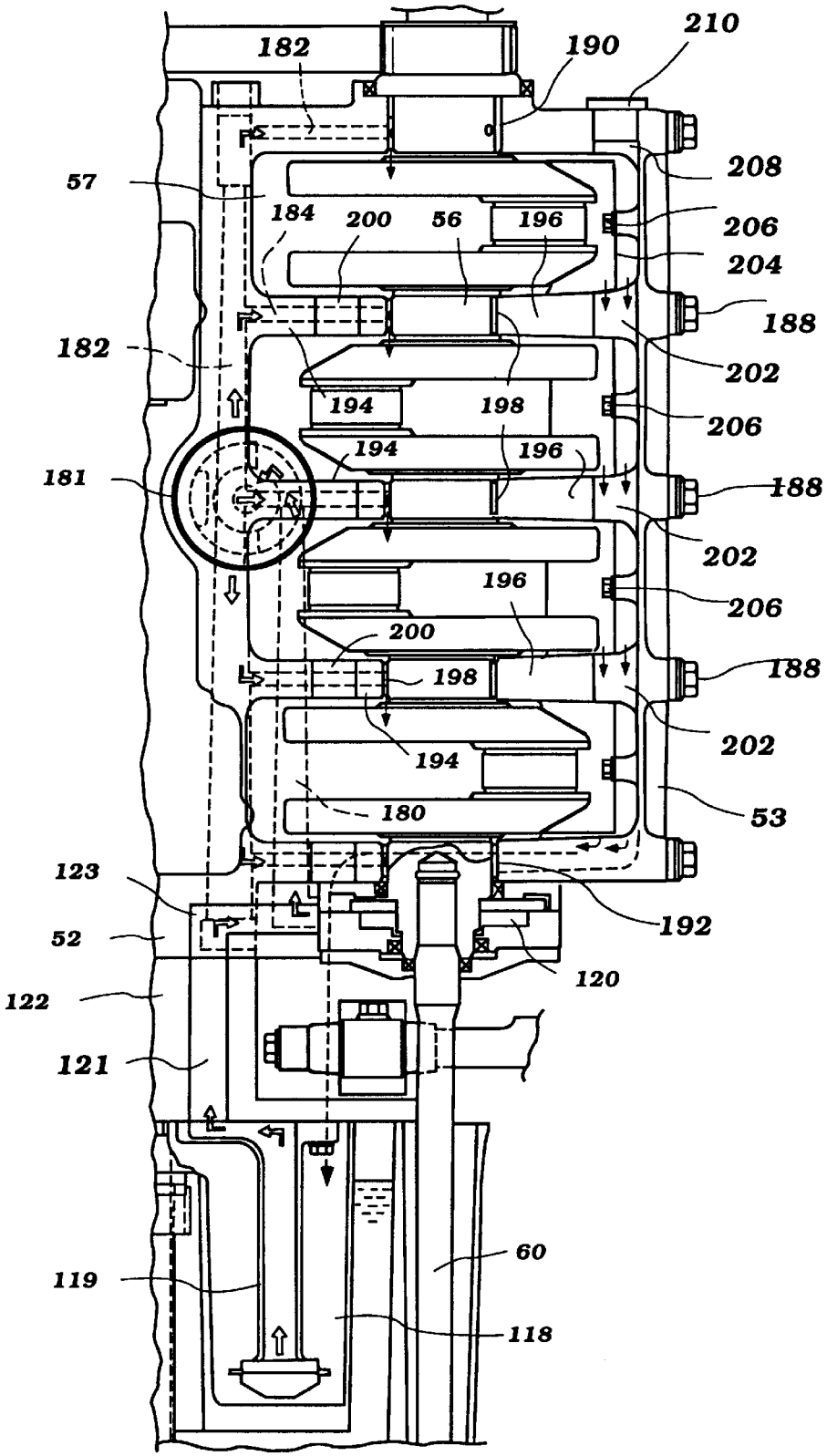
FIG. 7 is an enlarged cross-sectional view of a crankcase portion of the engine illustrated in FIG. 2, illustrating the bearing arrangement in accordance with the first embodiment of the present invention.
Figure 8:
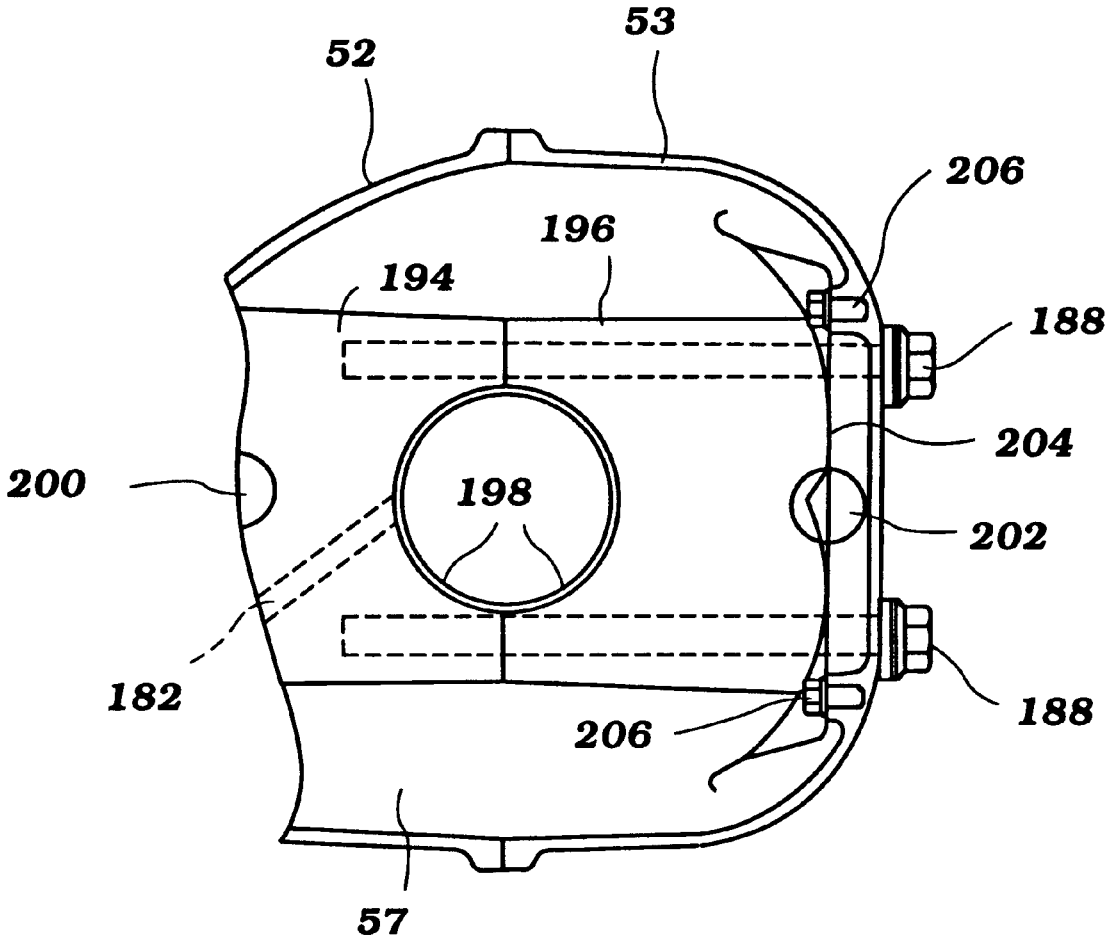
FIG. 8 is a partial cross-sectional view of the crankcase taken perpendicular to the crankshaft.
Figure 9:
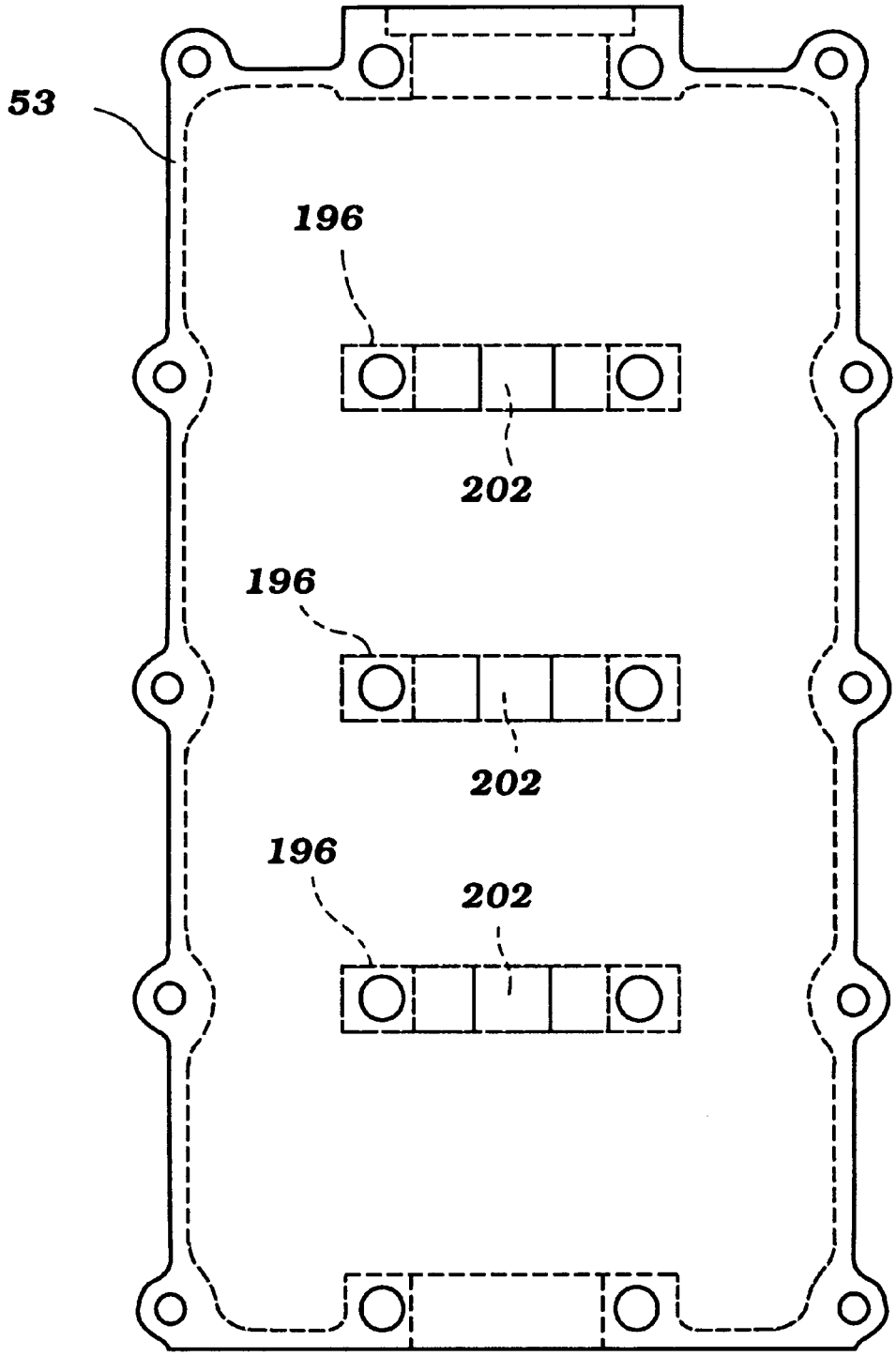
FIG. 9 is a plan view of a first side of a crankcase cover of the crankcase illustrated in FIG. 7.

In accordance with the present invention, the motor 20 has an crankshaft bearing arrangement. FIGS. 7–9 best illustrate a bearing arrangement in accordance with a first embodiment of the present invention. As illustrated therein, the crankcase chamber 57 is a space within a portion of the cylinder block 52 and connected crankcase cover 53. The cover 53 is removably attached to the block 52 by one or more bolts 188 or other fasteners.

The crankshaft 56 is journalled for rotation with respect to the cylinder block 52 and cover 53. As illustrated, the crankshaft 56 is positioned within an upper bearing 190 in the cylinder block 52 at a top end of the engine 22. In addition, the crankshaft 56 is journalled for rotation within a lower bearing 192 positioned in a lower portion of the cylinder block 52. As described above, the crankshaft 56 is connected to the drive shaft 60 at the lower end of the engine 22. As also described above, the oil pump 120 is mounted at the interconnection of the crankshaft 56 and drive shaft 60 for rotation thereby.

The crankshaft 56 is supported by additional bearings between the upper and lower bearings 190,192. As illustrated, three spaced-apart webs 194 extend outwardly from the cylinder block 52 within the chamber 57. Three corresponding webs 196 extend inwardly from the cover 53 and are preferably formed integrally therewith. The webs 194,196 each have a half-bearing 198 mounted thereon for surrounding half of the crankshaft 56. The mating half-bearings 198 encircle a portion of the crankshaft 56.

As described above, lubricating oil is provided to the bearings 190, 192, 198 for lubricating them. In addition, and in accordance with the present invention, means are provided for draining the lubricating oil from the crankcase chamber 57 back to the oil reservoir 118.

As illustrated, the oil is pumped from the pump 120 to a main passage 180 to an oil filter 181. After filtration, the oil passes into a main gallery 182 and thereon to individual distribution galleries 184. These distribution galleries 184 preferably extend though the webs 194 of the cylinder block 52 and the walls of the block for lubricating the bearings 190, 192, 198.

Oil supplied to the bearings 190, 192, 198 enters the crankcase chamber 57 and is then returned to the oil reservoir 118. Some oil passes through passages 200 formed through the webs 194 extending from the cylinder block 52. In addition, however, an oil flow path or passage is provided through the crankcase chamber generally opposite the cylinder block 52. In the first embodiment, this flow path or passage is defined by passages 202 formed through the webs 196 extending inwardly from the cover 53. Preferably, these passages 202 are aligned along a vertical axis adjacent the exterior wall of the cover opposite the cylinder block 52. These passages 202 may be formed by drilling, molding or in other manners known to those skilled in the art.

As best illustrated in FIGS. 7 and 8, a splash plate 204 is provided in the crankcase chamber 57. The plate 204 is arranged to stop oil which is thrown by the crankshaft 56 towards the cover 57 and divert the oil through the 202 to an oil drain back to the oil reservoir 118. The plate 204 is preferably arcuate in shape, extending somewhat around each side of the crankshaft 56 and along its length. The plate 204 is preferably connected to the cover 53 with a number of bolts 206 or similar fasteners.

As best illustrated in FIG. 8, the plate 204 is positioned so that it is aligned with the passages 202 through the webs 196. In this manner, oil which hits the plate 204 runs down the face of the tray and is directed through the passage 202 to the oil return.

As illustrated in FIG. 7, passage 208 is provided through the cover 53 at the top of the engine 22. A plug 210 is selectively positionable in the passage 208. A user may remove the plug 210 to add oil to the engine 22 by pouring it through the passage 208 into the crankcase chamber 57 for draining into the oil reservoir 118. It is also possible to position a similar passage and plug at the bottom of the crankcase cover 53 for draining oil therefrom.

Figure 10:
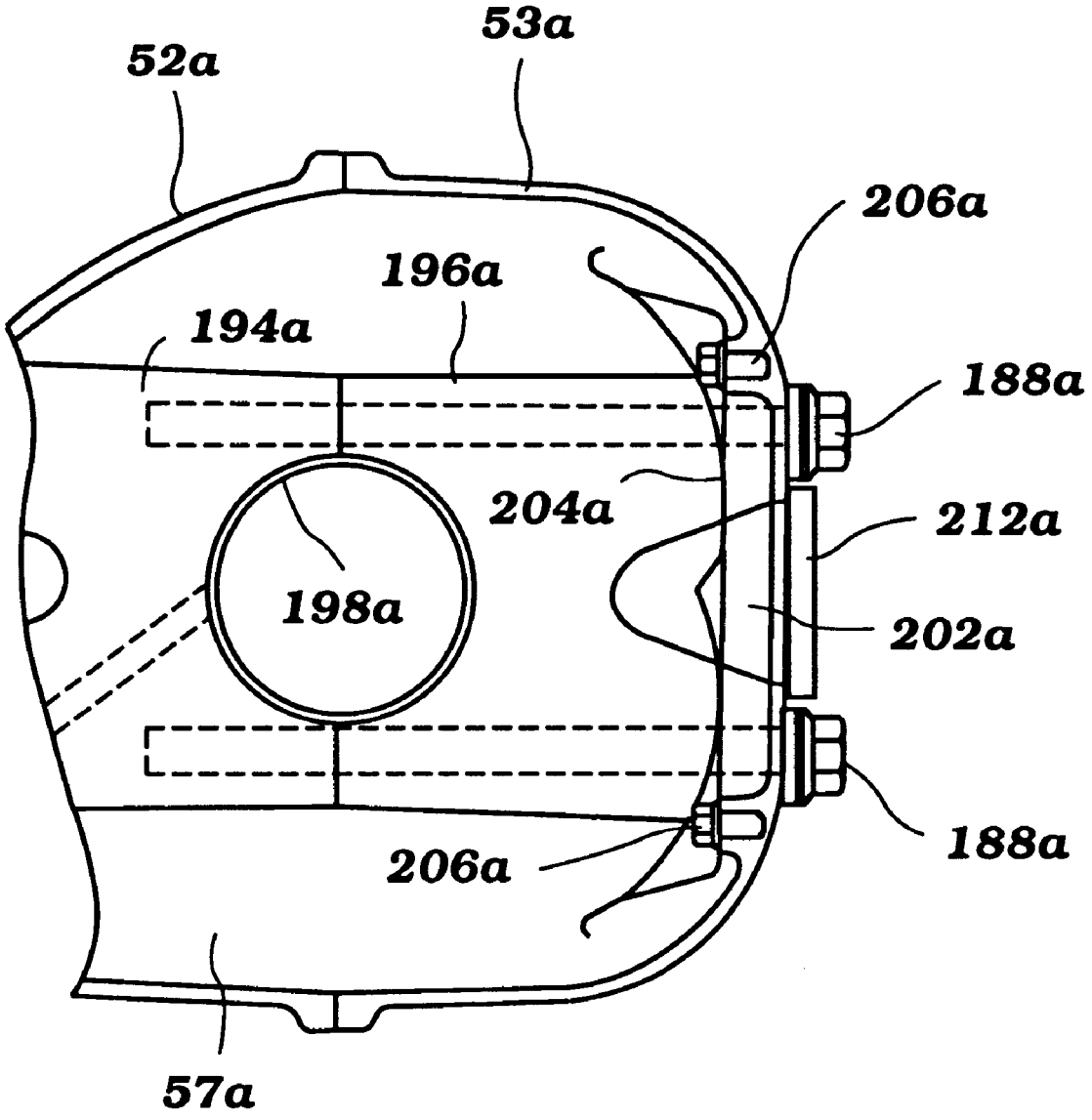
FIG. 10 is a partial cross-sectional view of a crankcase portion of an engine having a crankshaft bearing arrangement in accordance with an alternate embodiment of the present invention.
Figure 11:
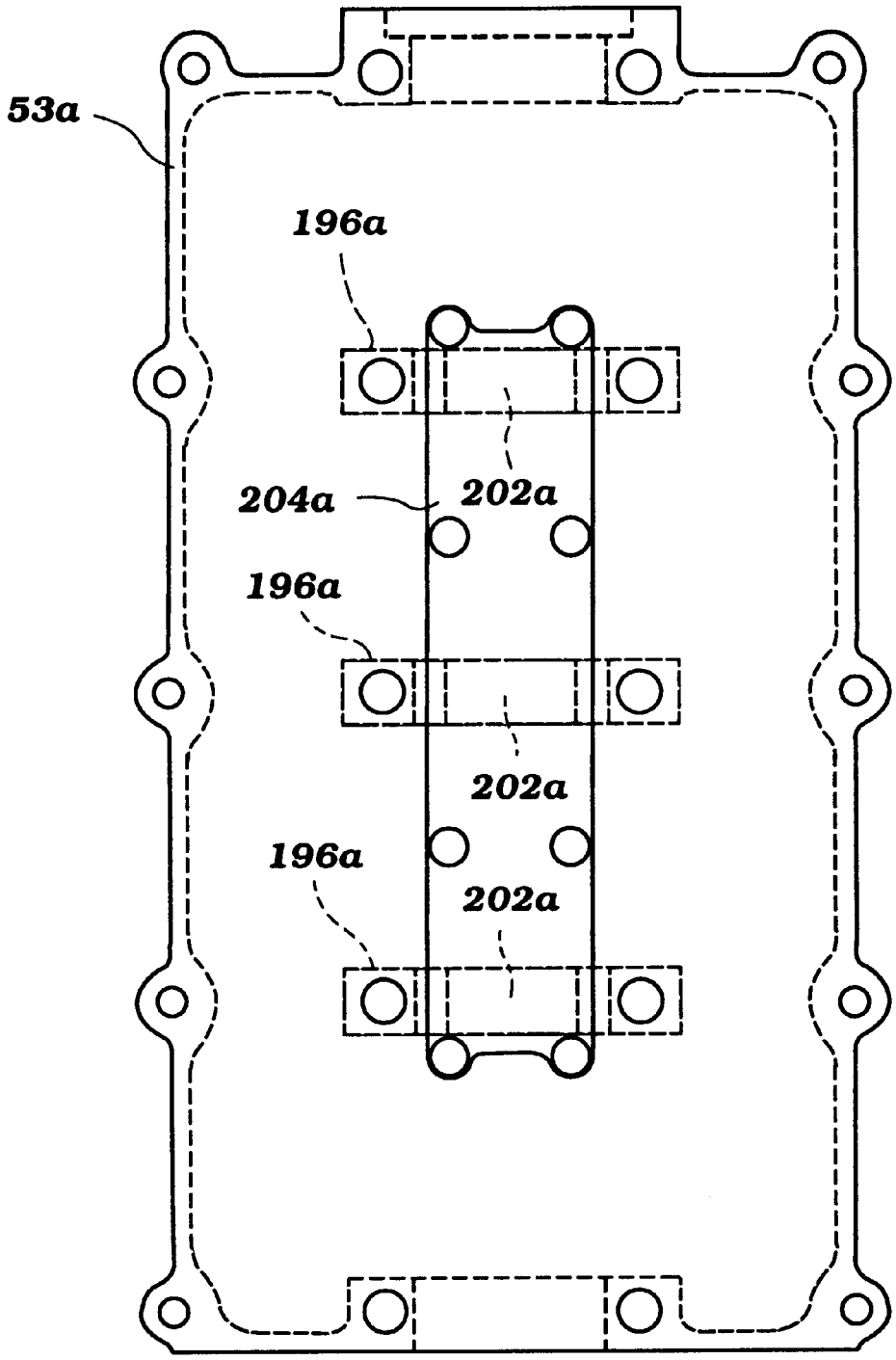
FIG. 11 is a plan view of a first side of a crankcase cover for the crankshaft bearing arrangement illustrated in FIG. 10.
Figure 12:
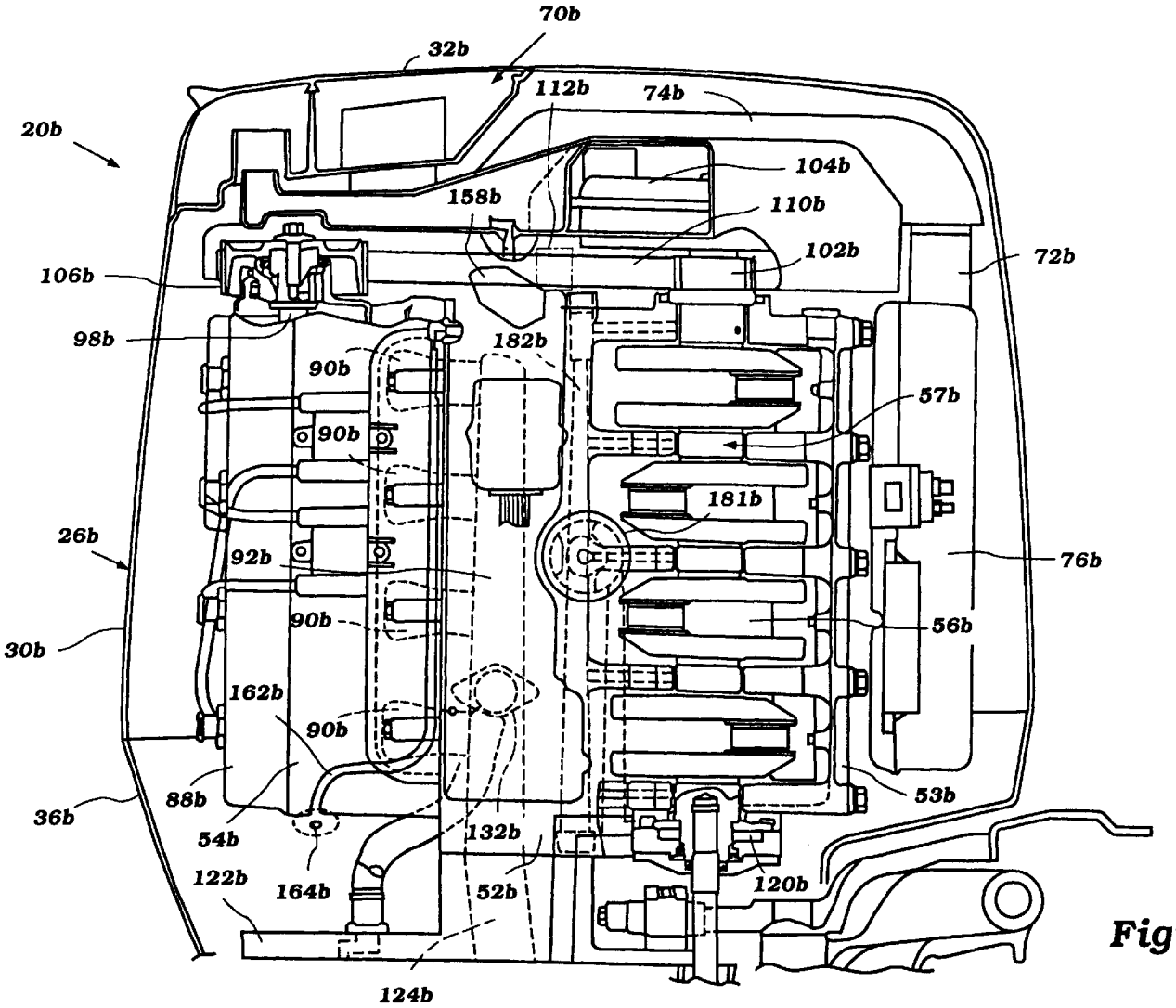
FIG. 12 is a cross-sectional side view of an engine for an outboard motor as illustrated in FIG. 1, the engine having a bearing arrangement in accordance with a third embodiment of the present invention.
Figure 13:
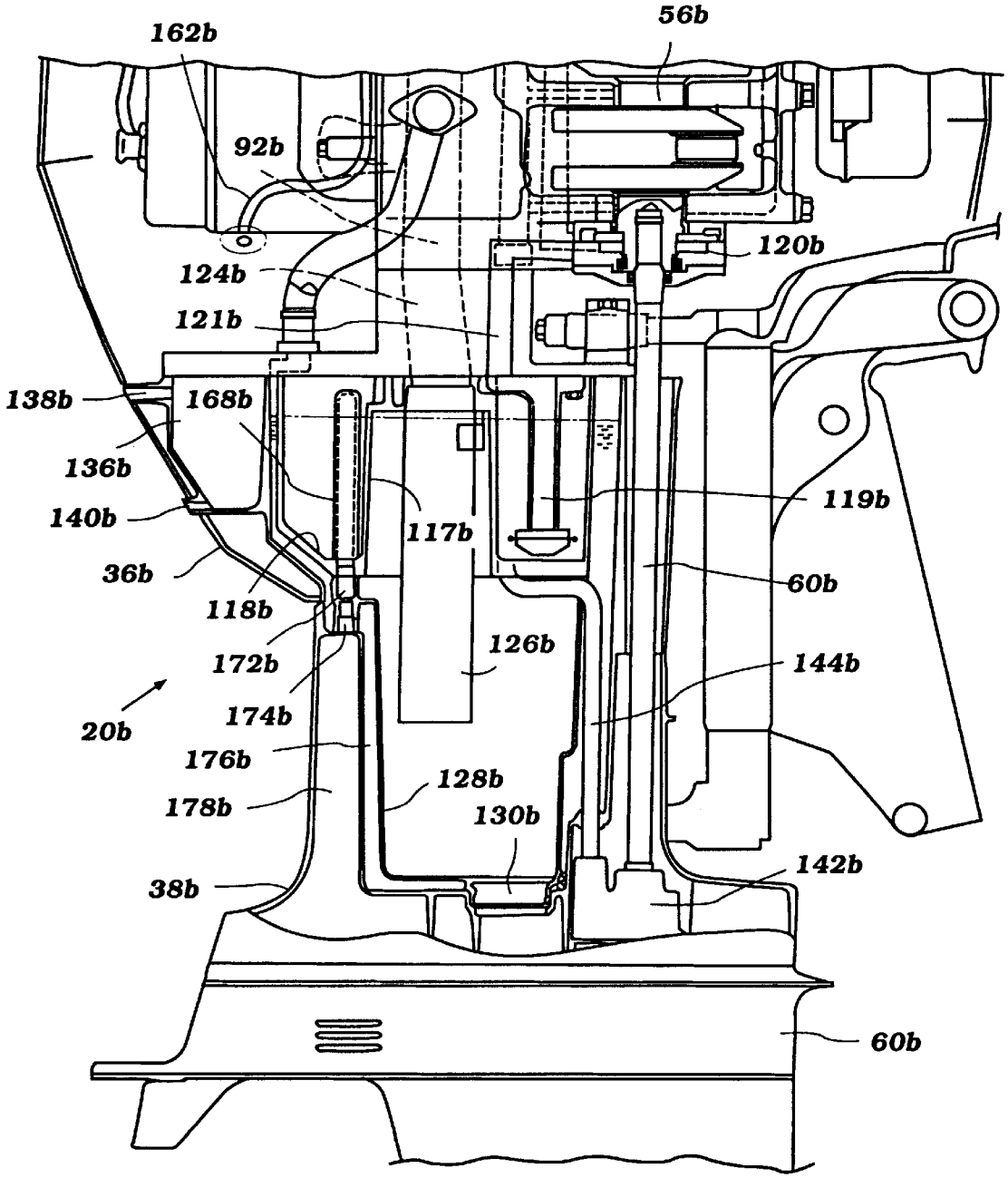
FIG. 13 is a cross-sectional side view of a lower portion of a motor having the engine illustrated in FIG. 12.

An second embodiment bearing arrangement in accordance with the present invention is illustrated in FIGS. 10 and 11. In this description, like parts have been given like numerals to those described above and illustrated in FIGS. 1–9, but include an "a" designator.

In this arrangement, the passage 202*a* which is formed through each web 196*a* of the cover 53*a* is formed in a molding process which leaves an opening in the face or wall of the cover 53*a*. After formation of the cover 53*a*, a cap 212*a* is placed in the portion of the opening through the face of the cover 53*a*.

FIGS. 12–17 illustrate a third embodiment of the crankshaft bearing or mounting arrangement in accordance with the present invention. In the description and drawings of this embodiment, like numerals have been used with like parts to those described in conjunction with the above-referenced embodiments, but include a "b" designator.

Preferably, the engine 20*b* is utilized to power a motor similar to that described above and illustrated in FIG. 1. In this arrangement, a connecting frame 214*b* has web portions 196*b* extending therefrom for mating engagement with the web portions 194*b* extending from the cylinder block 52*b*.

Figure 14:
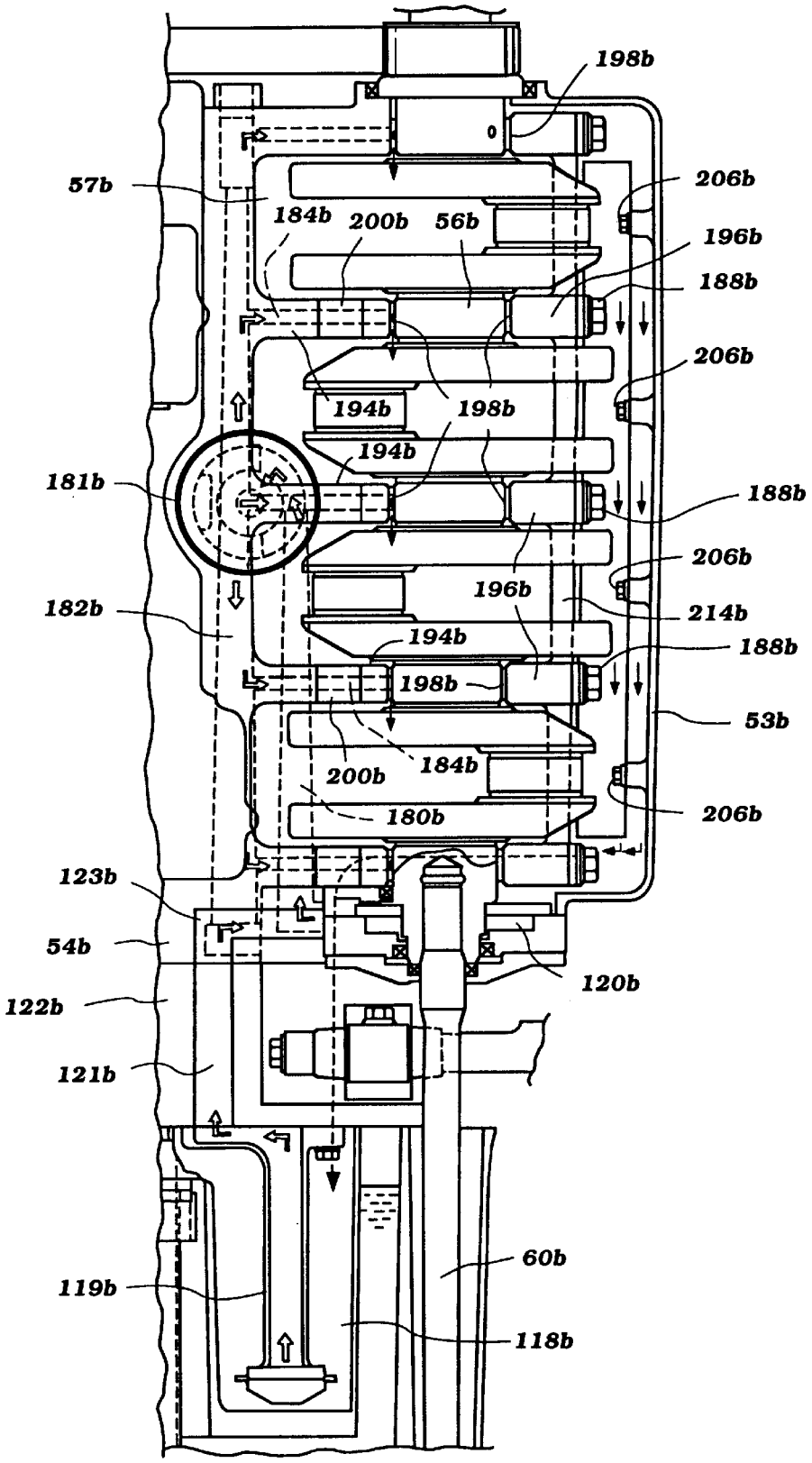
FIG. 14 is an enlarged cross-sectional view of the engine illustrated in FIG. 12, illustrating a crankcase chamber the bearing arrangement.

As best illustrated in FIG. 14, the connecting frame 214*b* has mounting holes extending therethrough, including the web portions 196*b*. The bolts 188*b* pass through the frame 214*b* into the web portions 194*b* corresponding to the cylinder block 52*b*. In this manner, the frame 214*b* is securely connected to the block 52*b*, and thus the bearing halves 198*b* are secured around the crankshaft 56*b*.

Figure 15:
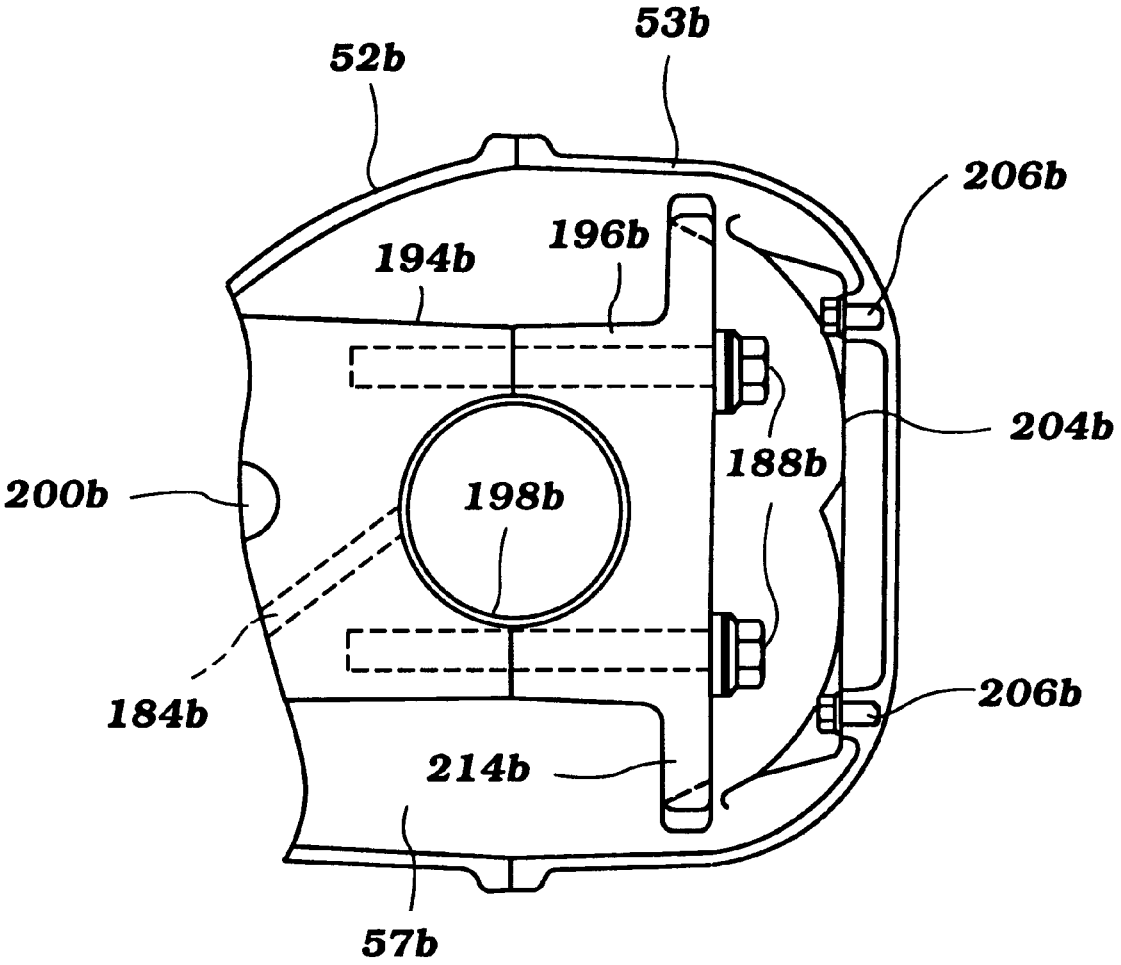
FIG. 15 is a cross-sectional view of the crankcase and bearing arrangement illustrated in FIG. 14, taken perpendicular to a crankshaft.
Figure 16:
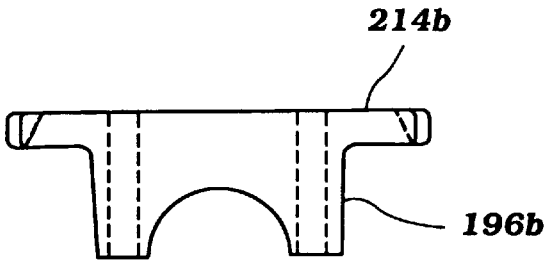
FIG. 16 is a plan end view of a crankcase cover for the crankcase illustrated in FIG. 15.
Figure 17:
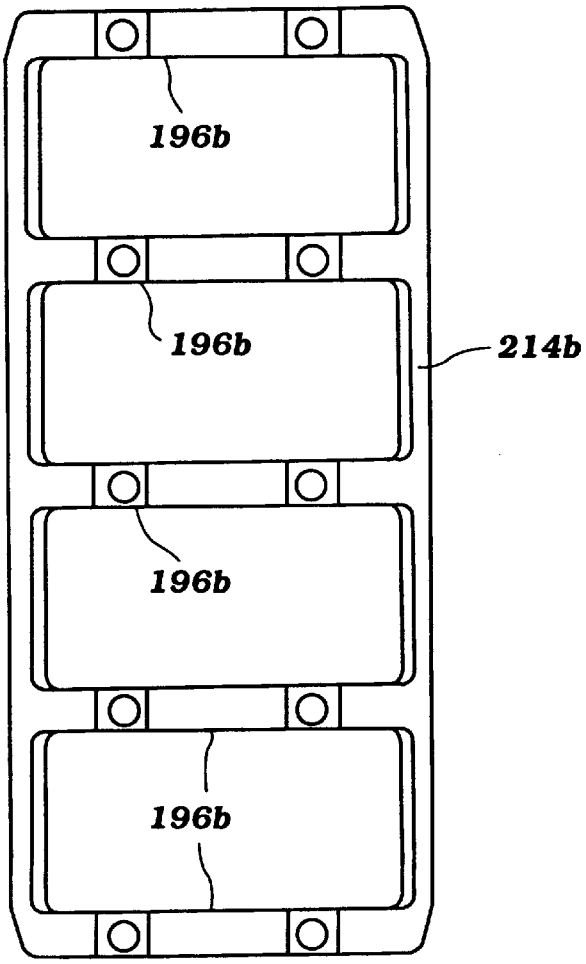
FIG. 17 is a plan top view of the crankcase cover illustrated in FIG. 16.

Notably, the frame 214*b*, and the web portions 196*b* connected thereto, is separate from the crankcase cover 53*b*. The cover 53*b* is independently connected to the cylinder block 53*b*. Most importantly, the outer wall or face of the cover 53*b* is spaced from the frame 214*b*, as best illustrated in FIGS. 14 and 15.

This arrangement is advantageous since an oil flow path is provided without the need for individual passages through the webs 196*b*. Oil may pass downwardly along the outer wall of the cover 53*b* in that space between the frame 214*b* and the wall of the cover 53*b*.

Again, in order to catch the oil which is being thrown about by the crankshaft 56*b* and to direct it to the bottom of the crankcase chamber 57*b*, a plate 204*b* is positioned between the outer wall of the cover 53*b* and the frame 214*b*. The plate 204*b* is preferably connected to the cover 53*b* by several bolts 206*b* or other fasteners.

This arrangement has the benefit that the crankcase cover may be removed without removing the web portions and half-bearings connected thereto, as in the above-described and illustrated embodiments. The construction of the assembly is also somewhat simplified, since the casting for the separate frame and cover is simpler as compared to the combined cover and web arrangement illustrated and described above.

Figure 18:
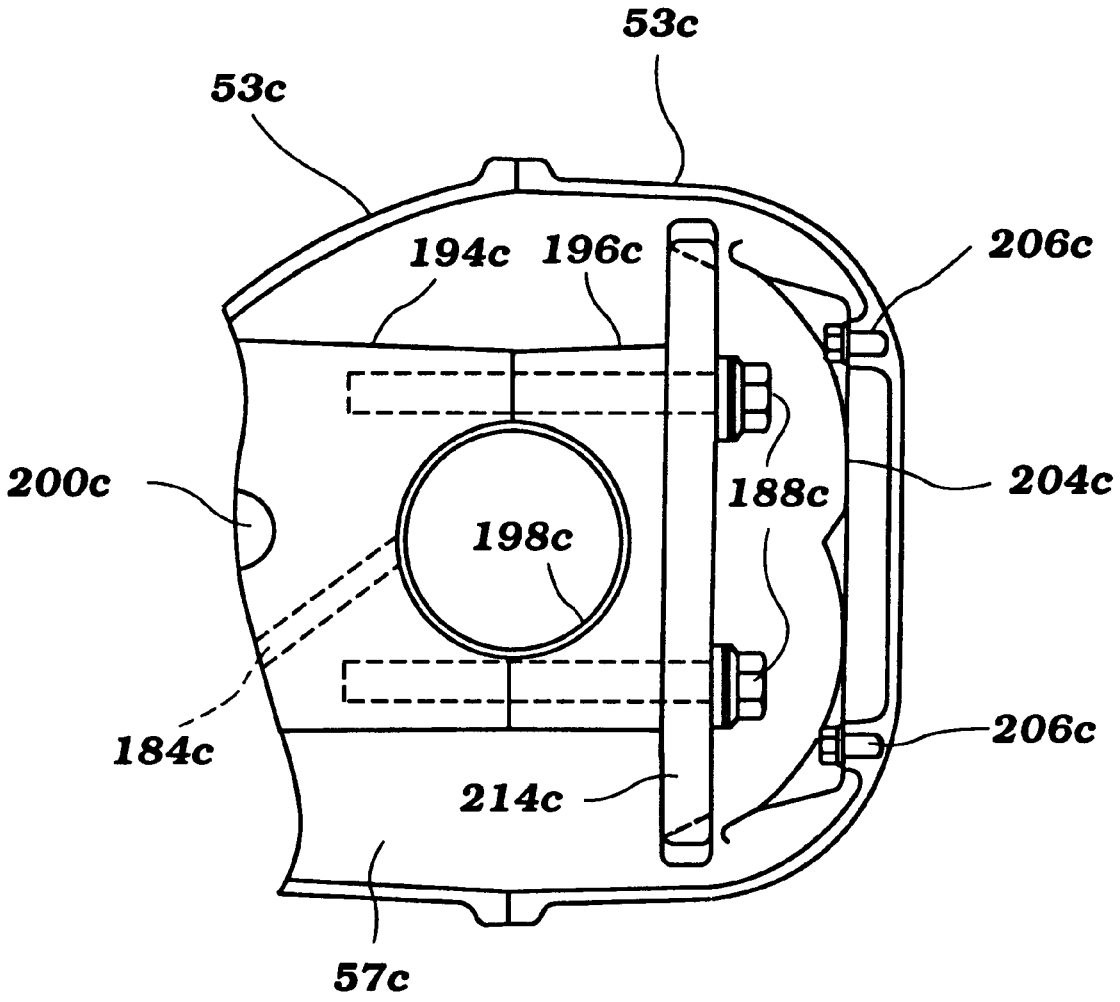
FIG. 18 is a cross-section view of a crankcase and bearing arrangement in accordance with a fourth embodiment of the present invention.
Figure 19:
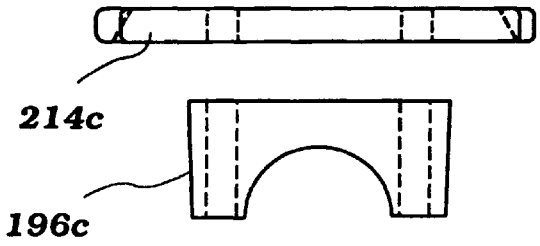
FIG. 19 is a plan end view of a crankcase cover and supporting web of the crankcase and bearing arrangement illustrated in FIG. 18.
Figure 20:
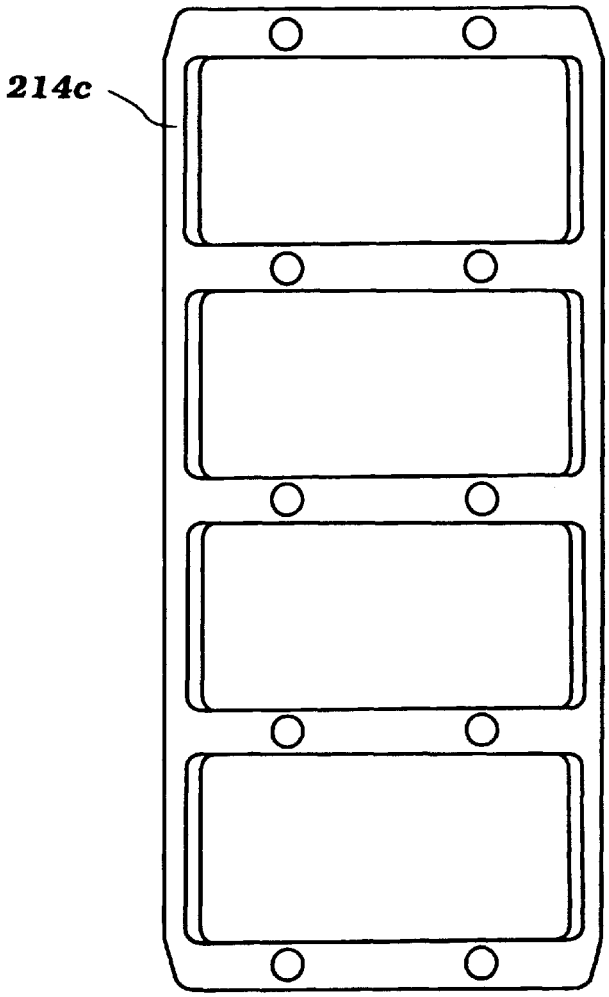
FIG. 20 is a plan top view of the crankcase cover illustrated in FIG. 19.

FIGS. 18–20 illustrate a fourth embodiment crankshaft bearing or mounting arrangement in accordance with the present invention. Again, like parts have been given like reference numerals to those utilized in conjunction with the embodiments described and illustrated in FIGS. 1–17, except that a "c" designator has been added.

This embodiment is nearly identical to the last, as illustrated in FIGS. 12–17. In this embodiment, however, the web portions 196*c* are separate from the frame portion 214*c* of the crankcase cover 53*c*. As best illustrated in FIG. 19, the frame 214*c* again includes through holes for mounting bolts, as do the web portions 196*c*. When mounted, the bolts 188*c* pass through the frame 214*c* and web portions 196*c* into the cylinder block 52*c*, rotatably retaining the crankshaft in a manner described above. The crankcase cover 53*c* is again spaced from the frame 214*c*, thereby providing an oil through passage for draining the oil to the bottom of the crankcase chamber 57*c*.

This arrangement is advantageous, at least in part, because the half-bearings 198*c* mounted on each web portion 196*c* may be individually replaced without the need to replace the entire frame and all connected web portions and half-bearings as in the embodiment illustrated in figures above.

Of course, the foregoing description is that of preferred embodiments of the invention, and various changes and modifications may be made without departing from the spirit and scope of the invention, as defined by the appended claims.

What is claimed is:

1. A crankshaft mounting arrangement for an internal combustion engine which is arranged such that the crankshaft thereof is vertically oriented, the engine having a cylinder block with a crankshaft cover connected to said cylinder block and cooperating therewith to define a crankshaft chamber in which at least a portion of said crankshaft rotates, said crankshaft chamber having a top end and a bottom end and said crankshaft cover having a wall generally opposite said cylinder block and defining one vertically extending termination of said crankshaft chamber, said cylinder block having at least one first crankshaft supporting member extending therefrom into said crankshaft chamber, a second crankshaft supporting member mating with said first crankshaft supporting member and defining therewith a bearing area for said crankshaft, said second crankshaft supporting member connected to said cylinder block and having a crankshaft supporting end defining a portion of said bearing area, and an oil flow passage defined through said crankshaft supporting end of said second crankshaft supporting member and surrounded thereby and spaced inwardly of said wall of said crankcase cover, whereby lubricating oil supplied into said crankshaft chamber may flow through said oil flow passage generally in the direction from said top end to said bottom end of said crankshaft chamber past said second crankshaft supporting member.

2. The crankshaft mounting arrangement in accordance with claim 1, wherein said second crankshaft supporting member comprises a web extending inwardly from said wall of said crankshaft cover, and said oil flow passage comprises a passage through said web.

3. The crankshaft mounting arrangement in accordance with claim 2, wherein said passage through said web is positioned near said wall.

4. The crankshaft mounting arrangement in accordance with claim 2, including a lubricating oil deflector plate positioned within said crankshaft chamber between said wall and said crankshaft.

5. The crankshaft mounting arrangement in accordance with claim 4, wherein said at least a portion of said plate is aligned with said passage for diverting oil impacting said lubricating oil deflector plate into said passage.

6. The crankshaft mounting arrangement in accordance with claim 1, wherein said second crankshaft supporting member has a second end opposite said crankshaft supporting end, and wherein said wall of said crankshaft cover is spaced from said second end of said second crankshaft supporting member and said passage comprises said space between said crankshaft cover and said second end of said second crankshaft supporting member.

7. The crankshaft mounting arrangement in accordance with claim 6, wherein said second crankshaft supporting member extends from a frame member, said frame member spaced from said wall.

8. The crankshaft mounting arrangement in accordance with claim 6, wherein said second crankshaft supporting member is positioned between a frame member and said first crankshaft supporting member.

9. The crankshaft mounting arrangement in accordance with claim 6, further including a lubricating oil deflector plate positioned between said second end of said second crankshaft supporting member and said crankshaft cover.

10. The crankshaft mounting arrangement in accordance with claim 1, wherein said first crankshaft supporting member supports a half-bearing and said second crankshaft supporting member supports a half-bearing.

11. The crankcase mounting arrangement in accordance with claim 1, wherein a second oil passage is provided through said first crankshaft supporting member.

12. A crankshaft mounting arrangement for an internal combustion engine which is arranged such that the crankshaft thereof is vertically oriented, the engine having a cylinder block with a crankshaft cover connected to said cylinder block and cooperating therewith to define a crankshaft chamber in which at least a portion of said crankshaft rotates, said crankcase chamber having a top end and a bottom end, said cylinder block having at least one first crankshaft supporting member extending into said chamber, a second crankshaft supporting member mating with said first crankshaft supporting member and defining therewith a bearing area for said crankshaft, said second crankshaft supporting member connected to said cylinder block, and an oil flow passage defined through and surrounded by said second crankshaft supporting member, whereby lubricating oil supplied into said crankcase chamber may flow generally in the direction from said top end to said bottom end of said crankshaft chamber and through said second crankshaft supporting member.

13. The crankshaft mounting arrangement in accordance with claim 12, wherein said oil flow passage is defined by a passage through said second crankshaft supporting member.

14. The crankshaft mounting arrangement in accordance with claim 12, wherein said oil flow passage comprises a space between said second crankshaft supporting member and said crankshaft cover.

15. The crankshaft mounting arrangement in accordance with claim 12, wherein said second crankshaft supporting member comprises a web member extending from said cover and said oil flow passage is defined by a passage through said web member.

16. The crankshaft mounting arrangement in accordance with claim 12, wherein said second crankshaft supporting member comprises a web member extending from a frame member, said frame member connected to said cylinder block and separated from said crankshaft cover, and said oil flow passage comprises said space between said frame and said crankshaft cover.

17. The crankshaft mounting arrangement in accordance with claim 12, wherein said second crankshaft support member comprises a web member, said web member positioned between a frame member and said first crankshaft supporting member.

18. The crankshaft mounting arrangement in accordance with claim 12, further including a lubricating oil diverter plate connected to said crankshaft cover and positioned generally opposite said cylinder block and oriented to divert lubricating oil to said oil flow passage.

* * * * *